US006185853B1

(12) United States Patent
Sniezak et al.

(10) Patent No.: US 6,185,853 B1
(45) Date of Patent: Feb. 13, 2001

(54) SPEEDLOADER FOR SHOTGUN

(75) Inventors: Gary A Sniezak, Columbia, SC (US); Milton W Erickson, Merrillan, WI (US); Zdenek Prisovsky, Kitchener (CA)

(73) Assignee: FN Manufacturing Co Inc, Columbia, SC (US)

( * ) Notice: Under 35 U.S.C. 154(b), the term of this patent shall be extended for 0 days.

(21) Appl. No.: 09/299,503

(22) Filed: Apr. 26, 1999

(51) Int. Cl.[7] ..... F42B 39/00
(52) U.S. Cl. ..... 42/87
(58) Field of Search ..... 42/87, 88, 90; 89/34

(56) References Cited

U.S. PATENT DOCUMENTS

| | | | | |
|---|---|---|---|---|
| 211,691 | | 1/1879 | Bennett . | |
| 2,885,811 | * | 5/1959 | Womble, Jr. | 42/50 |
| 2,981,024 | * | 4/1961 | Skoff | 42/87 |
| 4,509,284 | | 4/1985 | Naber | 42/87 |
| 4,614,052 | * | 9/1986 | Brown et al. | 42/87 |
| 4,720,931 | * | 1/1988 | Jensen | 42/87 |
| 4,756,110 | | 7/1988 | Beltron | 42/87 |
| 4,862,621 | | 9/1989 | Kearney | 42/87 |
| 4,864,758 | * | 9/1989 | Crossman | 42/17 |
| 4,867,039 | * | 9/1989 | Dobbins | 89/127 |
| 4,939,862 | | 7/1990 | Brandenburg et al. | 42/88 |
| 5,054,221 | | 10/1991 | Ozols | 42/87 |
| 5,072,537 | * | 12/1991 | Velezis | 42/18 |
| 5,109,623 | | 5/1992 | French | 42/90 |
| 5,452,533 | * | 9/1995 | Bentley | 42/17 |
| 5,669,171 | | 9/1997 | Sally | 42/87 |

FOREIGN PATENT DOCUMENTS

| | | | | |
|---|---|---|---|---|
| 205661 | * | 12/1986 | (EP) | 42/87 |
| 331218 | * | 9/1989 | (EP) | 42/87 |

* cited by examiner

*Primary Examiner*—Stephen M. Johnson
(74) *Attorney, Agent, or Firm*—Michael A Mann; Nexsen Pruet Jacobs & Pollard LLP

(57) ABSTRACT

A speedloader for a shotgun having a tubular magazine includes an integral pulley system to minimize handle travel in delivering a plurality of cartridges into the magazine. The speedloader comprises a frame with a channel therethrough dimensioned to receive a plurality of cartridges. The frame carries a handle on an exterior longitudinal track and, inside, a pusher that travels from the first end of the frame to the second end of the frame in response to movement of the handle, thereby expelling the cartridges from the speedloader and injecting them into the magazine. The pulley system translates movement of the handle to movement of the pusher and reduces the distance the handle needs to be moved to move the pusher the full distance to reload the shotgun.

18 Claims, 4 Drawing Sheets

SPEEDLOADER FOR SHOTGUN

BACKGROUND OF THE INVENTION

1. Field of the Invention

The present invention relates to devices for loading cartridges into weapons. In particular, the present invention relates to a speedloading device for use with shotguns.

2. Discussion of Background

Semi-automatic shotguns have been devised with a tubular magazine for holding a plurality of shells. Upon firing the shotgun, a cartridge is automatically loaded into the chamber from the magazine, so that a number of rounds can be fired in quick succession; however, the magazine typically only holds five cartridges and reloading the magazine can be a slow process. In fact, the speed in which the shotgun can be reloaded may be a matter of life or death. Since the typical magazine is permanent and cannot be replaced with a "fresh" magazine, cartridges must be fed through the carrier opening one-by-one.

Various attempts have been made to develop a device that more quickly reloads a shotgun, which has a tubular magazine. For example, U.S. Pat. No. 4,509,284 to Naber discloses a plunger disposed with a tube dimensioned to hold a plurality of cartridges. The plunger is positioned behind the cartridges and expels the cartridges upon moving the entire length of the tube into the magazine. Naber not only requires the plunger to travel the entire length of the tube, but has also been noted for difficulty in alignment during loading. U.S. Pat. No. 4,756,110 to Beltron also describes a plunger disposed within a tube that travels the entire length of the tube to expel the cartridges into the magazine. In order to improve the alignment difficulties found in Naber, a latch is placed on the tube which engages the trigger guard. U.S. Pat. No. 4,862,621 to Kearney also advances a plunger disposed within a tube that travels the entire length of the tube to expel the cartridges into the magazine. In order to improve alignment problems, a bracket is mounted to the shotgun which engages alignment projections on the tube. Although each one of the patented devices improves the speed in which the shotgun could be manually loaded, the overall reload speed is based on the time it takes for the user to move the handle.

Therefore, there is a need for a speedloading device with an improved loading rate that can be easily aligned.

SUMMARY OF THE INVENTION

According to its major aspects and broadly stated, the present invention is a speedloader for a shotgun having a tubular magazine. The speedloader interfaces with a shotgun carrier opening to enable rapid reload of a tubular magazine with cartridges. The speedloader has a frame with a channel therethrough that is dimensioned to receive a plurality of cartridges. The frame has a longitudinal track that slidably carries a handle. A pusher slidably received within the channel is capable of traveling from the first end of the frame to the second end of the frame in response to movement of the handle, thereby expelling the cartridges into the magazine. The frame carries a pulley system between the handle and the pusher so that the pusher travels the entire length of the channel in response to the handle moving only a portion of the length.

A major advantage of the present invention is the speed in which a plurality of cartridges can be loaded into the tubular magazine of a shotgun. If the user of a shotgun is being attacked or under fire, the speed with which a shotgun can be reloaded may be a matter of life or death, thereby making this advantage of upmost importance.

A pulley system that minimizes movement of the handle to expel a plurality of cartridges from the speedloader is a major feature of the present invention. Since the handle does not need to travel the entire length of the frame, as in prior art speedloaders, the loading time is reduced.

Another important advantage of the present invention is the simplicity of design. By simply adding a ribbon and pulley to the design, the pusher travels approximately twice the distance as the handle, thereby improving the reloading speed.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 3A:
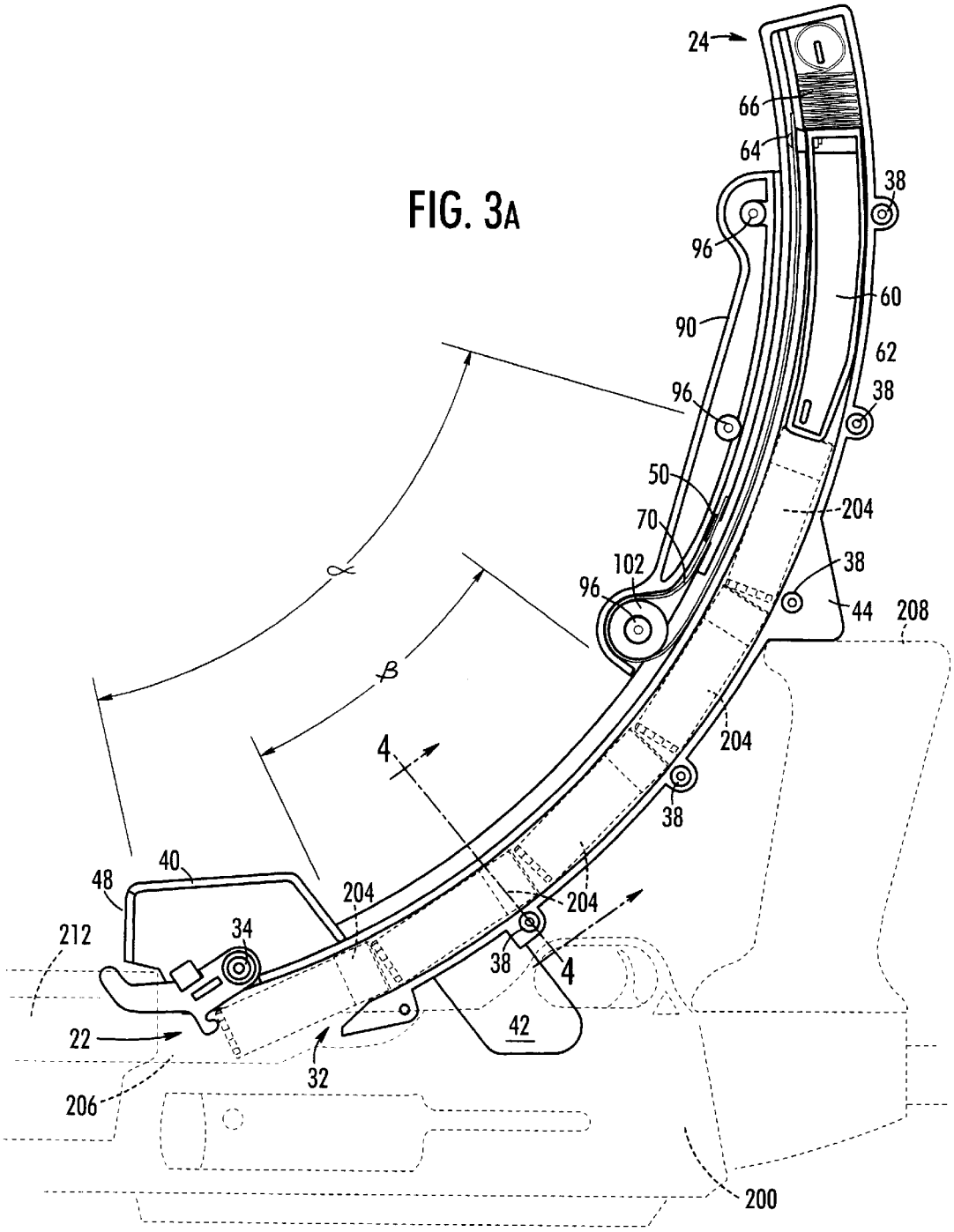
FIG. 3A is a side cross-sectional view of a speedloader interfacing with a shotgun prior to loading cartridges, according to a preferred embodiment of the present invention.
Figure 3B:
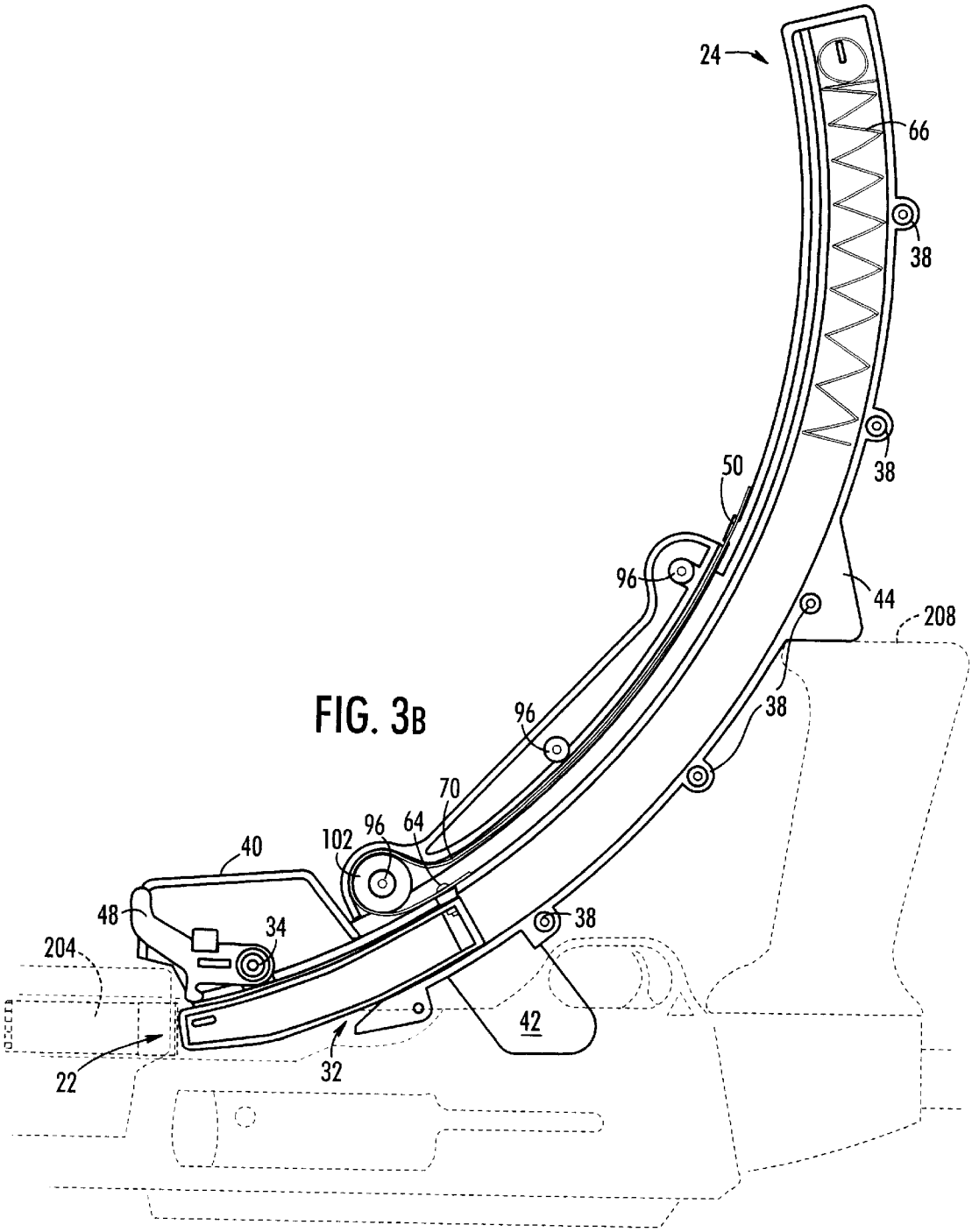
FIG. 3B is a side cross-sectional view of a speedloader interfacing with a shotgun after loading cartridges, according to a preferred embodiment of the present invention.

Referring now to the figures, the present invention is a speedloader for a shotgun having a tubular magazine. The speedloader, generally referred to by reference number 10, interfaces with a shotgun 200 carrier opening 206 to reload a tubular magazine (not shown) with cartridges 204. Speedloader 10 has a frame 20 with a channel 30 therethrough that is dimensioned to receive a plurality of cartridges 204. Frame 20 has a longitudinal track 46 that slidably carries a handle 90. A pusher 60 slidably received within channel 30 is capable of traveling from the first end 22 of frame 20 to the second end 24 of frame 20 in response to movement of handle 90, thereby expelling cartridges 204 from speedloader 10 and injecting them into magazine 202 as illustrated in FIGS. 3A and 3B. Frame 20 carries a pulley system between handle 90 and pusher 60 so that pusher 60 travels the entire length of channel 30 in response to handle 90 moving a portion of the length.

Frame 20 has a channel 30 extending longitudinally therethrough sufficiently dimensioned to carry a plurality of cartridges 204 that are stacked end-to-end. In terms of orientation, frame 20 has a first end 22 and a second end 24. Second end 24 of frame has an opening 32 that allows cartridges 204 to exit channel 30.

Figures 2, 4:
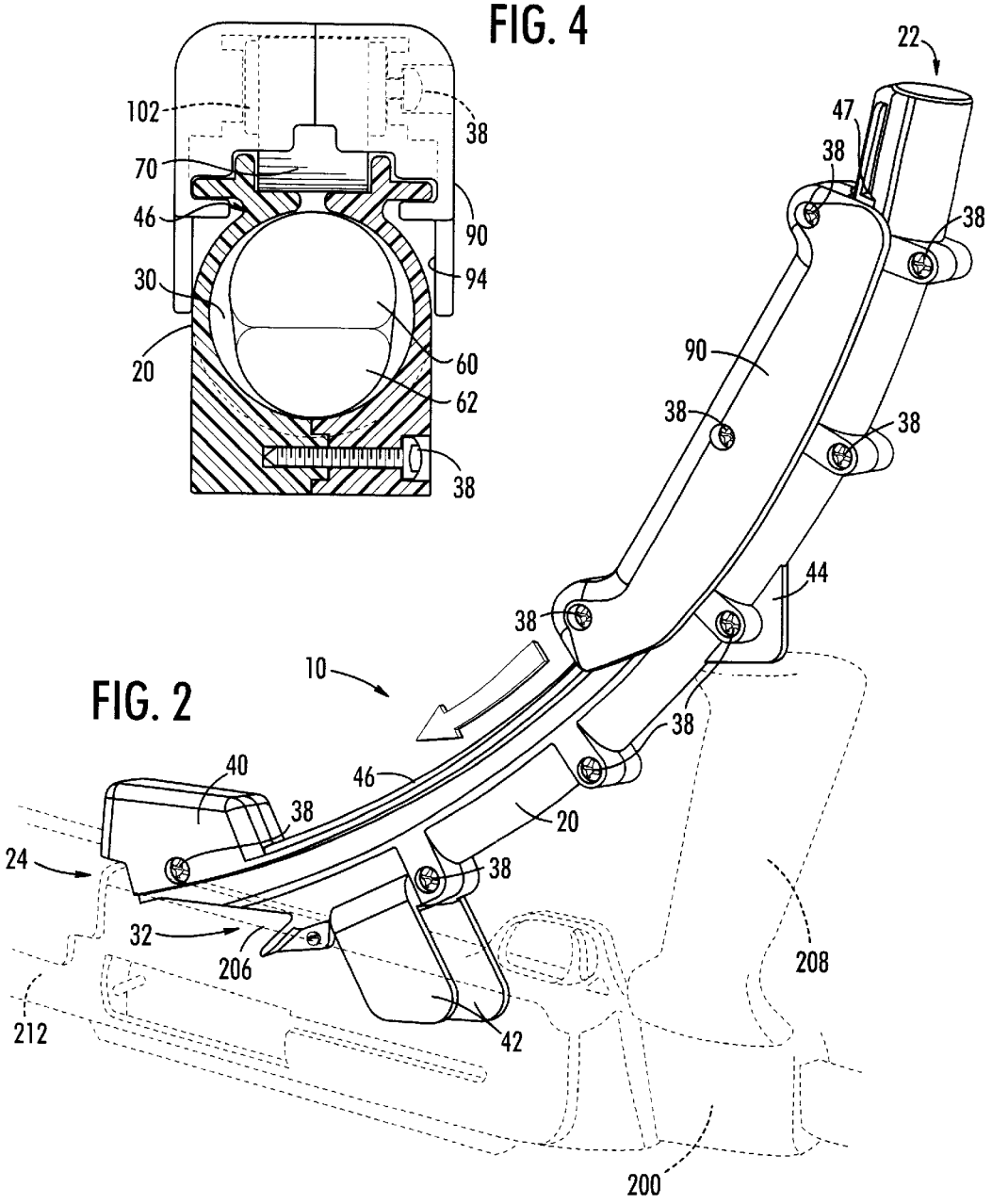
FIG. 2 is a perspective view of a speedloader interfacing a shotgun shown in ghost, according to a preferred embodiment of the present invention.
FIG. 4 is a cross-sectional view of the speedloader.

As illustrated in FIG. 2, frame 30 interfaces with shotgun 200 when second end 24 is received by carrier opening 206 of shotgun 200. Frame 20 has a curved shape that allows sufficient clearance of shotgun 200 handle 208. Preferably, curvature of frame 20 is such that second end 24 is tangent with shotgun 200 barrel 212. In order to aid alignment and balance during loading, a pair of alignment brackets 42 extend downwardly from frame 20 near opening 32. Alignment brackets 42 overlap barrel 212 in conjunction with a flange 44 that rests on handle 208. With alignment brackets 42 and flange 44, frame 20 is stable during reloading.

Although frame 20 could be constructed as a single piece, multiple pieces or numerous other ways as will be clear to those skilled in the art, preferably frame 20 is constructed from a first portion 26 and a second portion 28 that can be secured together. In order to fasten first portion 26 to second portion 28, a plurality of male members 34 interface with female members 36. A screw 38 extends through each female member 36 into each male member 34 so that first portion 26 is securely attached to second portion 28.

A latch 48 is rotatably secured between a female member 36 and male member 34 positioned near the second end 24 of frame 20. Latch 48 rotates between an closed position as illustrated in FIG. 3A and an open position as illustrated in FIG. 3B. In a closed positioned, latch 48 engages the leading cartridge 204 to prevent escape from channel 30. In contrast, cartridges 204 are free to exit channel 30 in an open position. With latch 48, speedloader 10 may be transported with channel 30 full of cartridges 204 without concern that any cartridge 204 will unintentionally exit from channel 30. When speedloader 10 is ready for use, latch 48 can be easily switched to an open position for loading cartridges 204 into magazine 202.

Figure 1:
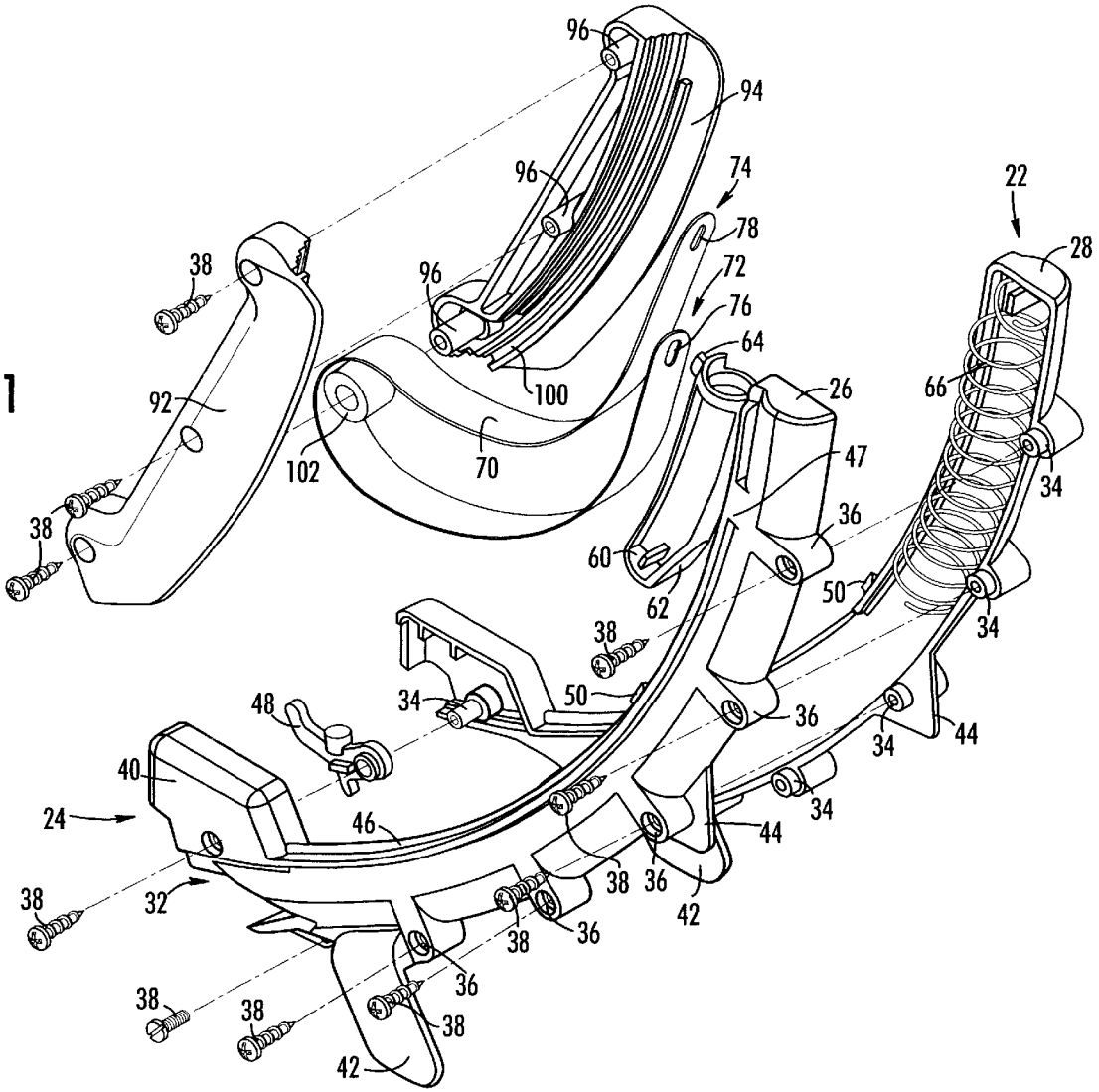
FIG. 1 is an exploded view of a speedloader, according to a preferred embodiment of the present invention.

Frame slidably carries a pusher 60 within channel 30 and is adapted to allow pusher 60 to travel from first end 22 to second end 24 of frame 20. A spring 66 within channel 30, attached to the first end 22 of frame 20, urges pusher 60 to second end 24 of frame 20. When speedloader 10 is loaded with cartridges 204, tapered end 62 of pusher 60 is adjacent to the cartridge 204 that is closest to the first end 22 of frame 20 as illustrated in FIG. 3A. Pusher 60 preferably has a tapered end 62 for clearance in passing through opening 32 of channel 30. A projection 64 is positioned on top of pusher 60 to receive first notch 76 of ribbon 70 as best illustrated in FIG. 1.

Frame 20 has a longitudinal track 46 that slidably receives a handle 90. Along track 46, a projection 50 receives second notch 78 of ribbon 70. Preferably, projection 50 is positioned approximately between the middle and first end 22 of frame 20. Near first end 22 of frame 20, track 46 has a stop 47 to limit movement of handle 90 toward first end 22.

A ribbon 70 with first end 72 having a first notch 76 and second end 74 having a second notch 78 extends between frame 20 and pusher 60. First end 72 is attached to pusher 60 with second end 74 attached to frame 20 as best illustrated in FIG. 3A. In conjunction with handle 90, ribbon 70 pulls pusher 60 from first end 22 of frame 20 to second end 24 of frame 20 as best illustrated in FIGS. 3A and 3B. Ribbon 70 may be formed from numerous materials that are highly flexible and resilient but with little elasticity, but preferably is made of steel.

A handle 90 slidably rides on track 46 to pull pusher 60 from first end 22 of frame 20 to second end 24 of frame 20, thereby expelling cartridges 204. Although handle 90 could be constructed as a single piece, multiple pieces or numerous other ways as will be clear to those skilled in the art, preferably handle 90 is constructed from a first piece 92 and a piece that can be secured together. In order to fasten first piece 92 to second piece 94, a plurality of dowels 96 interface with receiving members 98. A screw 38 extends through each receiving member 98 into each dowel 96 so that first piece 92 is securely attached to second piece 94. A slot 100 extends longitudinally on both first piece 90 and second piece 92 to be slidably received by track 46.

A pulley 102 having an aperture of sufficient dimension received by a dowel 96 rotatably engages the dowel 96 closest to opening of frame 20. As best illustrated in FIG. 3A, first end 72 of ribbon 70 is attached to pusher 60 and wrapped around pulley 102 to be attached to second end 74 of ribbon 70. With this arrangement, pusher 60 travels preferably approximately twice the distance as handle 90 does. As illustrated in FIG. 3A, pusher 60 travels a distance $\alpha$ while handle 90 travels a distance $\beta$ and where $\alpha$ is approximately twice $\beta$.

In use, with channel 30 filled with cartridges 204, latch 48 is in the closed position so that speedloader 10 cartridges do not fall out. When the magazine 202 in shotgun 200 is empty of cartridges 204, switch latch 48 to an open position and place second end 24 of frame 20 into carrier opening 206 so that alignment brackets 42 overlap barrel 212 and flange 44 rests on handle 208 of shotgun 200. Next, move handle 90 along track 46 toward opening 32 in frame 20 until pusher 60 expels all cartridges 204 from channel 30 into magazine 202.

It will be apparent to those skilled in the art that many changes and substitutions can be made to the preferred embodiment herein described without departing from the spirit and scope of the present invention.

What is claimed is:

1. A speedloader for a shotgun having a magazine, said speedloader comprising:

a frame, said frame having a channel formed therein and dimensioned to receive a plurality of cartridges, said frame having a first end and an opposing second end, said first end and said second end being spaced-apart thereby defining a first distance therebetween;

a pusher slidably received within said channel for expelling the cartridges from said channel, said pusher movable between said first end and said second end of said channel; and handle means in operative connection with said pusher for moving said pusher between said first end and said second end of said channel, said handle means including a handle, and a ribbon having a first end and a second end, said first end of said ribbon attached to said pusher and said second end of said ribbon attached to said handle.

2. The speedloader as recited in claim 1, wherein said frame further comprises a track and said handle slidably engages said track.

3. The speedloader as recited in claim 1, wherein said frame further comprises a track having a first end and an opposing second end, said first and second ends of said track spaced apart by a second distance, said second distance being less than said first distance.

4. The speedloader as recited in claim 3, wherein said handle slidably engages said track.

5. The speedloader as recited in claim 3, wherein said second distance is approximately half said first distance.

6. The speedloader as recited in claim 1, wherein said handle means further comprises a pulley system and said ribbon is wrapped around said pulley system.

7. The speedloader as recited in claim 1, further comprising a latch attached to said second end of said frame, said latch capable of moving between a closed position that restricts movement of the cartridges in said channel and an open position that allows free movement of the cartridges within said channel.

8. The speedloader as recited in claim 1, further comprising a spring carried within said channel of said frame and positioned near said first end of said frame, said spring urging said pusher from said first end of said frame to said second end of said frame.

9. A speedloader for a shotgun having a magazine, said speedloader comprising:

a frame, said frame having a channel formed therein and dimensioned to receive a plurality of cartridges, said frame having a first end and an opposing second end, said first end and said second end being spaced-apart thereby defining a first distance therebetween, said frame having a track with a first end and an opposing second end, said first and second ends of said track spaced apart by a second distance, said second distance being approximately half said first distance;

a pusher slidably received within said channel for expelling the cartridges from said channel, said pusher movable between said first end and said second end of said channel; and handle means in operative connection with said pusher for moving said pusher between said first end and said second end of said channel, said handle means slidably engaging said track.

10. The speedloader as recited in claim 9, wherein said handle means includes:

a handle slidably engaging said track; and a ribbon having a first end and a second end, said first end of said ribbon attached to said pusher and said second end of said ribbon attached to said handle.

11. The speedloader as recited in claim 10, wherein said handle means further comprises a pulley system and said ribbon is wrapped around said pulley system.

12. The speedloader as recited in claim 9, further comprising a latch attached to said second end of said frame, said latch capable of moving between a closed position that restricts movement of the cartridges in said channel and an open position that allows free movement of the cartridges within said channel.

13. The speedloader as recited in claim 9, further comprising a spring carried within said channel of said frame and positioned near said first end of said frame, said spring urging said pusher from said first end of said frame to said second end of said frame.

14. A speedloader for a shotgun having a magazine, said speedloader comprising:

a frame, said frame having a channel formed therein and dimensioned to receive a plurality of cartridges, said frame having a first end and an opposing second end, said first end and said second end being spaced-apart thereby defining a first distance therebetween;

a pusher slidably received within said channel for expelling the cartridges from said channel, said pusher movable between said first end and said second end of said channel;

a handle slidably carried by said frame; and a ribbon having a first end and a second end, said first end of said ribbon attached to said pusher and said second end of said ribbon attached to said handle.

15. The speedloader as recited in claim 14, wherein said frame has a track with a first end and an opposing second end, said first and second ends of said track spaced apart by a second distance, said second distance being less than said first distance, said handle slidably engaging said track.

16. The speedloader as recited in claim 14, wherein said handle means further comprises a pulley system and said ribbon is wrapped around said pulley system.

17. The speedloader as recited in claim 14, further comprising a latch attached to said second end of said frame, said latch capable of moving between a closed position that restricts movement of the cartridges in said channel and an open position that allows free movement of the cartridges within said channel.

18. The speedloader as recited in claim 14, further comprising a spring carried within said channel of said frame and positioned near said first end of said frame, said spring urging said pusher from said first end of said frame to said second end of said frame.

* * * * *